US007823700B2

(12) United States Patent
Boss et al.

(10) Patent No.: US 7,823,700 B2
(45) Date of Patent: Nov. 2, 2010

(54) USER IDENTIFICATION ENABLED ELEVATOR CONTROL METHOD AND SYSTEM

(75) Inventors: Gregory Jensen Boss, American Fork, UT (US); Christopher James Dawson, Arlington, VA (US); Rick Allen Hamilton, II, Charlottesville, VA (US); Timothy Moffett Waters, Hiram, GA (US)

(73) Assignee: International Business Machines Corporation, Armonk, NY (US)

( * ) Notice: Subject to any disclaimer, the term of this patent is extended or adjusted under 35 U.S.C. 154(b) by 641 days.

(21) Appl. No.: 11/780,527

(22) Filed: Jul. 20, 2007

(65) Prior Publication Data

US 2009/0020370 A1 Jan. 22, 2009

(51) Int. Cl.
*B66B 1/34* (2006.01)

(52) U.S. Cl. ..... 187/384; 187/247; 187/391

(58) Field of Classification Search ..... 187/380–388, 187/391–396, 247
See application file for complete search history.

(56) References Cited

U.S. PATENT DOCUMENTS 5,159,163 A * 10/1992 Bahjat et al. ..... 187/381
5,345,049 A * 9/1994 Bahjat et al. ..... 187/382
5,841,084 A * 11/1998 Thangavelu ..... 187/382
6,152,265 A 11/2000 Bittar et al.
6,202,799 B1 * 3/2001 Drop ..... 187/388
6,394,232 B1 * 5/2002 Iwata et al. ..... 187/382
6,473,704 B1 10/2002 Ito et al.
6,772,862 B2 * 8/2004 Friedli ..... 187/247
6,988,071 B1 1/2006 Gazdzinski
7,093,693 B1 * 8/2006 Gazdzinski ..... 187/384
7,581,622 B2 * 9/2009 Amano ..... 187/384
2005/0246094 A1 11/2005 Moscatiello
2005/0284706 A1 12/2005 Vecchiotti et al.
2009/0294221 A1 * 12/2009 Bahjat et al. ..... 187/396

OTHER PUBLICATIONS

Xiong, et al., Group Elevator Scheduling with Advanced Traffic Information for Normal Operations and Coordinated Emergency Evacuation; Proceedings of the 2005 IEEE, International Conference on Robotics and Automation, Barcelona, Spain, Apr. 2005; pp. 1419-1424.

* cited by examiner

*Primary Examiner*—Jonathan Salata
(74) *Attorney, Agent, or Firm*—Schmeiser, Olsen & Watts; William E. Schiesser

(57) ABSTRACT

An elevator control method and system. The system comprises a control unit and a memory unit. The memory unit comprises user data segments associated with users for elevators within the system and transponder identification data segments associated with transponders. The method comprises receiving by the control unit, ID signals from the transponders. The control unit associates the user data segments with the ID signals and determines priority levels for the users.

11 Claims, 5 Drawing Sheets

USER IDENTIFICATION ENABLED ELEVATOR CONTROL METHOD AND SYSTEM

FIELD OF THE INVENTION

The present invention relates to a method and associated system for controlling elevators.

BACKGROUND OF THE INVENTION

Transporting users to various locations within a facility typically comprises a manual process. Users requiring transport to the various locations within a facility are generally required to manually control the transport apparatus. Manually controlling the transport apparatus typically comprises an inefficient process that may be very time consuming. Accordingly, there exists a need in the art to overcome the deficiencies and limitations described herein above.

SUMMARY OF THE INVENTION

The present invention provides a method, comprising:

receiving, by an elevator control unit within an elevator system, user data segments associated with users for elevators within said elevator system, each user data segment of said user data segments associated with a different user of said users, said elevator system comprising a memory unit;

receiving, by said elevator control unit, transponder identification data segments associated with a plurality of transponders, each transponder identification data segment of said transponder identification data segments associated with a different transponder of said plurality of transponders, each transponder of said plurality of transponders associated with and possessed by a different user of said users;

storing said user data segments and said transponder identification data segments in said memory unit;

receiving, by said elevator control unit, a first identification signal from a first transponder of said plurality of transponders, said first transponder possessed by a first user of said users;

receiving, by said elevator control unit, a second identification signal from a second transponder of said plurality of transponders, said second transponder possessed by a second user of said users;

retrieving, by said elevator control unit in response to said first identification signal, a first user data segment of said user data segments stored in said memory unit, said first user data segment associated with said first user;

retrieving, by said elevator control unit in response to said second identification signal, a second user data segment of said user data segments stored in said memory unit, said second user data segment associated said second user;

determining, by said elevator control unit, a first priority level for said first user based on said first user data segment; and determining, by said elevator control unit, a second priority level for said second user based on said second user data segment.

The present invention provides an elevator control system comprising an elevator control unit, said elevator control unit comprising a processor coupled to a computer-readable memory unit, said memory unit comprising instructions that when executed by the processor implement an elevator control method, said method comprising:

receiving, by said elevator control unit, user data segments associated with users for elevators within said elevator system, each user data segment of said user data segments associated with a different user of said users;

receiving, by said elevator control unit, transponder identification data segments associated with a plurality of transponders, each transponder identification data segment of said transponder identification data segments associated with a different transponder of said plurality of transponders, each transponder of said plurality of transponders associated with and possessed by a different user of said users;

storing said user data segments and said transponder identification data segments on said computer-readable memory unit;

receiving, by said elevator control unit, a first identification signal from a first transponder of said plurality of transponders, said first transponder possessed by a first user of said users;

receiving, by said elevator control unit, a second identification signal from a second transponder of said plurality of transponders, said second transponder possessed by a second user of said users;

retrieving, by said elevator control unit in response to said first identification signal, a first user data segment of said user data segments in said memory unit, said first user data segment associated with said first user;

retrieving, by said elevator control unit in response to said second identification signal, a second user data segment of said user data segments in said memory unit, said second user data segment associated said second user;

determining, by said elevator control unit, a first priority level for said first user based on said first user data segment; and determining, by said elevator control unit, a second priority level for said second user based on said second user data segment.

The present invention provides a computer program product, comprising a computer usable medium comprising computer readable program code embodied therein, said computer readable program code comprising an algorithm adapted to implement an elevator control method within an elevator control system comprising an elevator control unit, said method comprising:

receiving, by said elevator control unit, user data segments associated with users for elevators within said elevator system, each user data segment of said user data segments associated with a different user of said users;

receiving, by said elevator control unit, transponder identification data segments associated with a plurality of transponders, each transponder identification data segment of said transponder identification data segments associated with a different transponder of said plurality of transponders, each transponder of said plurality of transponders associated with and possessed by a different user of said users;

storing said user data segments and said transponder identification data segments in said computer-readable memory unit;

receiving, by said elevator control unit, a first identification signal from a first transponder of said plurality of transponders, said first transponder possessed by a first user of said users;

receiving, by said elevator control unit, a second identification signal from a second transponder of said plurality of transponders, said second transponder possessed by a second user of said users;

retrieving, by said elevator control unit in response to said first identification signal, a first user data segment of said user data segments in said computer-readable memory unit, said first user data segment associated with said first user;

retrieving, by said elevator control unit in response to said second identification signal, a second user data segment of said user data segments in said computer-readable memory unit, said second user data segment associated said second user;

determining, by said elevator control unit, a first priority level for said first user based on said first user data segment; and determining, by said elevator control unit, a second priority level for said second user based on said second user data segment.

The present invention advantageously provides simple method and associated system capable of transporting users to various locations within a facility.

DETAILED DESCRIPTION OF THE INVENTION

Figure 1:
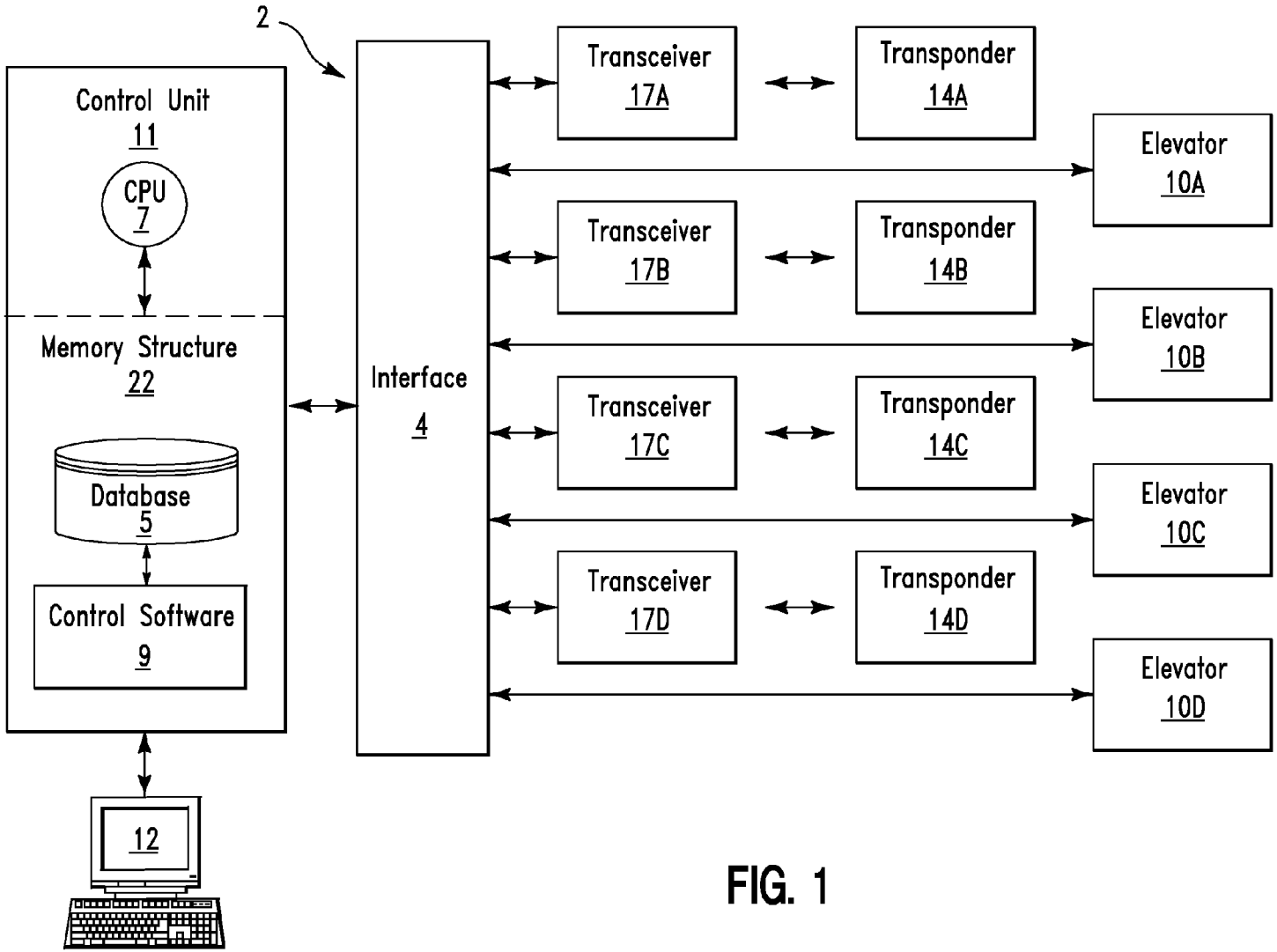
FIG. 1 illustrates a block diagram view of a system for controlling a plurality of elevators for a plurality of users, in accordance with embodiments of the present invention.

FIG. 1 illustrates a block diagram view of a system 2 for controlling a plurality of elevators 10A . . . 10D for a plurality of users, in accordance with embodiments of the present invention. System 2 in the description of FIG. 1 is located in a multilevel building requiring elevator service. Note that any number of elevators may be used in system 2 of FIG. 1. System 2 is used to:

1. Automatically detect users (e.g., passengers) waiting for an elevator(s) in a building.
2. Determine a priority level for each user.
3. Send an elevator or elevators (i.e., to retrieve the users) based on a number or priority level of the users.
4. Transport the users to specified floors.
5. Prevent users from accessing restricted floors.

System 2 comprises elevators 10A . . . 10D, a control unit 11, an interface 4, transceivers 17A . . . 17D, transponders 14A . . . 14D, and an input apparatus 12. Control unit 11 comprises a central processing unit (CPU) 7 and a memory structure 22. Memory structure comprises control software 9 and a database 5. Interface 4 electrically connects elevators 10A . . . 10D and transceivers 17A . . . 17D to control unit 11. Interface 4 may comprise any type of interface including, inter alia, a local area network (LAN), a wide area network (WAN), the Internet, etc. Transceivers 17A . . . 17D may comprise any type of transceiver including, inter alia, a radio frequency identification (RFID) tag reader, a wireless fidelity (Wi-Fi) transceiver, a Bluetooth transceiver, etc. Transponders 14A . . . 14D may comprise any type of transponder including, inter alia, an RFID tag, a wireless fidelity (Wi-Fi) transponder, a Bluetooth transponder, etc. Each of transceivers 17A . . . 17D is placed near an elevator(s) entrance on each floor of a building. Note that each floor may comprise multiple transceivers.

When a user enters the building, he or she will go to a security area (e.g., a security desk) to receive access to the building. User information is retrieved from the user and stored in database 5 as user data. The user information may be entered into database 5 using input apparatus 12. Alternatively, the user data may be stored within one of transponders 14A . . . 14D. User information may comprise, inter alia:

1. A name of the user
2. A class of the user with respect to offices or locations in the building. As a first example, in a place of business classes may include: visitor, employee, senior employee, VIP employee, etc. As a second example, in a hotel classes may include: standard guest, executive platinum guest, etc.
2. A floor that the user normally resides or floors to which they are restricted from accessing.

After the user data is stored, a transponder (e.g., one of transponders 14A . . . 14D) is assigned to the user. The transponder may be comprised by a user ID card. Transponder identification information for the assigned transponder is entered (e.g., through input apparatus 12) into database 5 and associated with the user data. For example, if the transponder is an RFID tag, a security badge comprising the RFID tag may be issued to the user and a serial number for the RFID tag may be stored as the transponder identification information. Thus, database 5 in control unit 11 comprises user data and associated transponder identification information for transponders possessed by all users in the building.

When the user moves within range of an elevator waiting area, a transceiver (e.g., one of transceivers 17A . . . 17D) automatically detects the transponder (e.g., one of transponders 14A . . . 14D) possessed by the user. The transceiver retrieves an identification signal from the transponder. The identification signal identifies the transponder. The identification signal is transmitted to the control unit and associated user data is retrieved from database 5. At this point, many different scenarios may occur.

As a first example, an elevator may be automatically retrieved by the control unit 11 for the user so that when the user reaches the elevator entrance, an elevator (e.g., one of elevators 10A . . . 10D) is already waiting to transport the user. The elevator may automatically transport the user to a specified floor based on the user data retrieved for the user. Additionally, the elevator may be restricted from stopping on certain floors that are restricted to the user. Control unit 11 may prevent the elevator from stopping on any other floors before the user reaches the specified floor.

As a second example, control unit 11 will determine a priority level for the user based on the user information (e.g., based on a class of the user). The user priority level is compared to other user priority levels for other users waiting on other floors for elevators. A first elevator is dispatched first to a user comprising a highest priority level. The first elevator may automatically transport the highest priority user to a specified floor based on the user data retrieved for the highest priority user. Additionally, the elevator may not be able to stop on certain floors that are restricted to the highest priority user. Control unit 11 may prevent the elevator from stopping on any other floors before the highest priority user reaches the specified floor. Next, a second elevator (or the first elevator if it has completed transporting the highest priority user) is dispatched to the next highest user and the process repeats.

As a third example, many users are detected within range of the elevator waiting area (i.e., on a single floor) and a specified number of elevators are dispatched to the elevator waiting area. The specified number of elevators dispatched is dependent on a number of users detected. In this instance, an estimated weight capacity for each elevator is calculated by control unit 11.

As a fourth example, many users are detected within range of elevator waiting areas on multiple floors and control unit 11 dispatches a first elevator to the floor that comprises a highest number of users or highest number of highest priority users.

Any combination of the aforementioned examples may be performed by system 2.

Additionally, in situations occurring during peak elevator use hours, groups of elevator users may be directed to specific elevators through the use of displays built into their ID cards comprising their transponders or overhead displays. This allows that each payload for each elevator is maximized while minimizing a number of stops for each elevator.

An example of implementation for system 2 is described as follows:

This example illustrates a hotel building with elevator system service to all floors. A guest registers at front desk of the building. Guest (e.g., user) information is inputted into database 5. The guest information determines that the user is an executive platinum user (i.e., a high priority user) and receives a hotel room on the top floor. A hotel receptionist codes the room number, default floor number, and the high priority user information into his/her room key (i.e., comprising an RFID tag) and/or database 5. The guest is issued the room key and identification information for the RFID tag is stored in database 5. The guest then walks toward the elevators. As he/she approaches the elevators, at a distance of approximately twenty feet, an installed RFID tag reader (e.g., one of transceivers 17A . . . 17D) detects the RFID tag (e.g., one of transponders 14A . . . 14D). The high priority user information, default floor information, and/or identification information for the RFID tag is sent to control unit 11. System 2 determines that the high priority user is requesting elevator service at the first floor and wishes to be taken to the top floor. Although there are other users waiting on the second and fourth floor, they are determined to be lower priority users (i.e., by their RFID tags). The elevator is dispatched to the high priority user. Optionally, the dispatched elevator may skip the second and fourth floors to immediately descend to the waiting high priority user. As the guest walks towards the elevator the doors open immediately and the guest is taken non-stop to the top floor.

Figure 2:
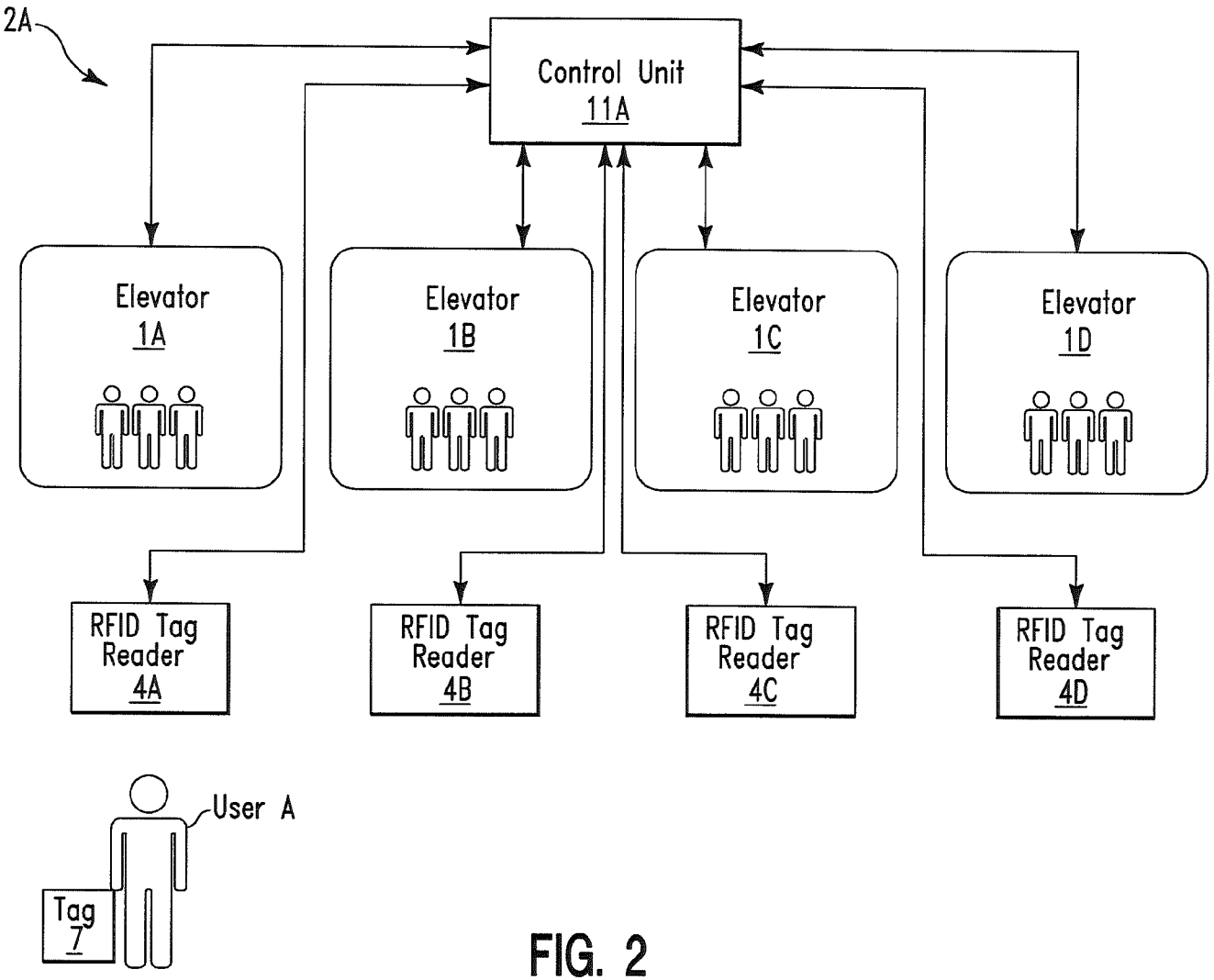
FIG. 2 illustrates an example block diagram of a system used to implement the system of FIG. 2, in accordance with embodiments of the present invention.

FIG. 2 illustrates a block diagram of a system 2A, in accordance with embodiments of the present invention. System 2A of FIG. 2 illustrates a security example implementation for system 2 of FIG. 1. System 2A comprises elevators 1A . . . 1D, RFID tag readers 4A . . . 4D, control unit 11A, and RFID tag 7 comprised by a user ID card. All of elevators 1A . . . 1D and RFID tag readers 4A . . . 4D are located in a single location on a lobby floor of an office building. Elevators 1A and 1B are restricted to transporting users to floors 1-19 and elevators 1C and 1D are restricted to transporting users to floors 20-40. In the example, the following user information is entered into and determined by control unit 11A.

1. User: User A
2. Class: Employee
3. Accessible Floors: 4-5
4. Priority Level: 1

RFID tag readers 4A . . . 4D periodically scan a specified vicinity surrounding the single location in order to detect any RFID tags entering the specified vicinity. As user A enters the specified vicinity, RFID tag 7 is detected by RFID tag readers 4A . . . 4D and RFID tag identification information (e.g., an electronic product code) is transmitted to control unit 11A. The identification information is cross referenced to the user information stored in control unit 11A. The user information specifies that user A may only access floors 4 or 5. Therefore, only elevators 1A or 1B (i.e., elevators 1A and 1B are restricted to transporting users to floors 1-19) may be dispatched to retrieve user A. Control unit 11A determines locations for elevators 1A and 1B. Control unit 11A determines that elevator 1A is transporting other users and elevator 1B is empty so therefore elevator 1B is dispatched to retrieve user A. A display on the ID card comprising RFID tag 7 instructs user A to use elevator 1B. When elevator 1B arrives, user A enters the elevator and selects either floor 4 or floor 5 and elevator 1B transports user A to the selected floor. No other floors may be selected by user A as they are considered to be restricted for user A.

Figure 3:
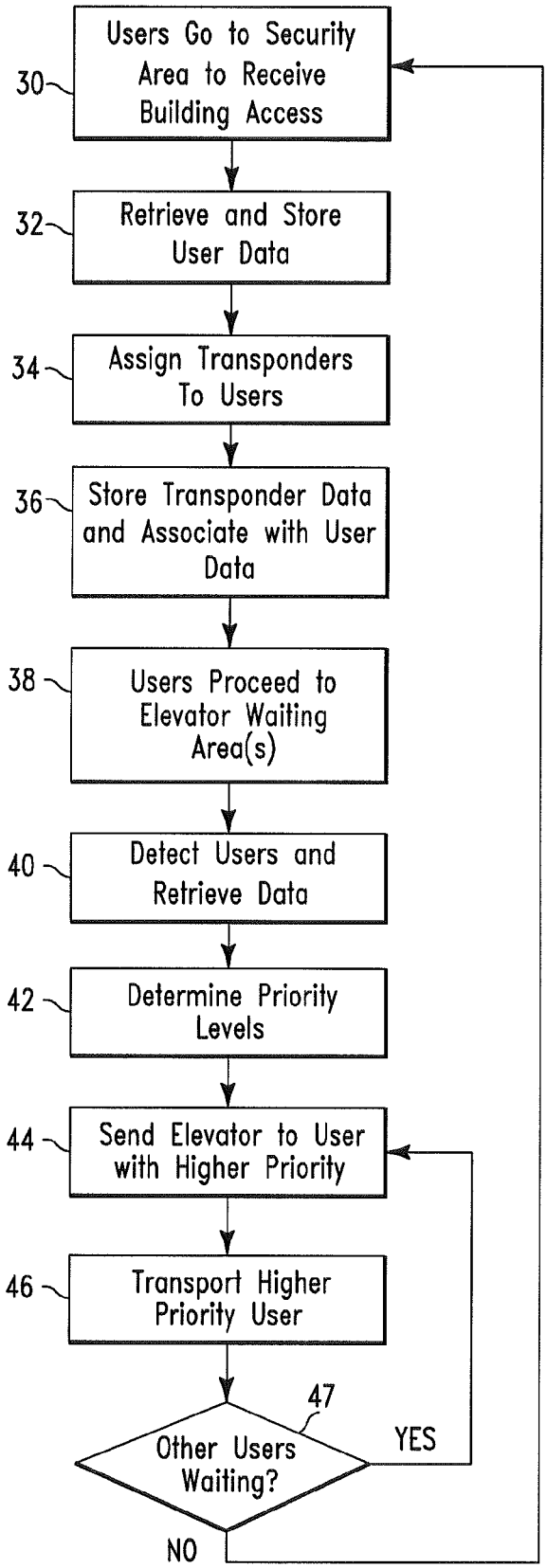
FIG. 3 is a flowchart illustrating an algorithm detailing an overall security process used by system of FIG. 1, in accordance with embodiments of the present invention.

FIG. 3 is a flowchart illustrating an algorithm detailing an overall security process used by system 2 of FIG. 1, in accordance with embodiments of the present invention. In step 30, users enter a building and go to a security area (e.g., a security desk) to receive access to different floors in the building. In step 32, user data is retrieved from the users and stored within database 5. In step 34, transponders (e.g., transponders 14A . . . 14D in FIG. 1) are assigned to the users. In step 36 transponder identification data is associated with the user data and stored in database 5. In step 38, the users proceed to an elevator waiting area. In step 40, the users are detected by a transceiver(s) (e.g., by one of transceivers 17A . . . 17D) and the user data is retrieved from database 5. In step 42, a priority level for each user is determined by control unit 11. In step 44 a first elevator is dispatched to the highest priority user. In step 46, the highest priority user is transported to a floor that is not restricted. In step 47, control unit 11 determines if any other users are still waiting for an elevator. If in step 47, control unit 11 determines that there are other users are still waiting for an elevator then step 44 is repeated to send another elevator to retrieve a user with a next highest priority. If in step 47, control unit 11 determines that there are no other users are still waiting for an elevator then step 30 is repeated and the aforementioned process is performed again.

Figure 4:
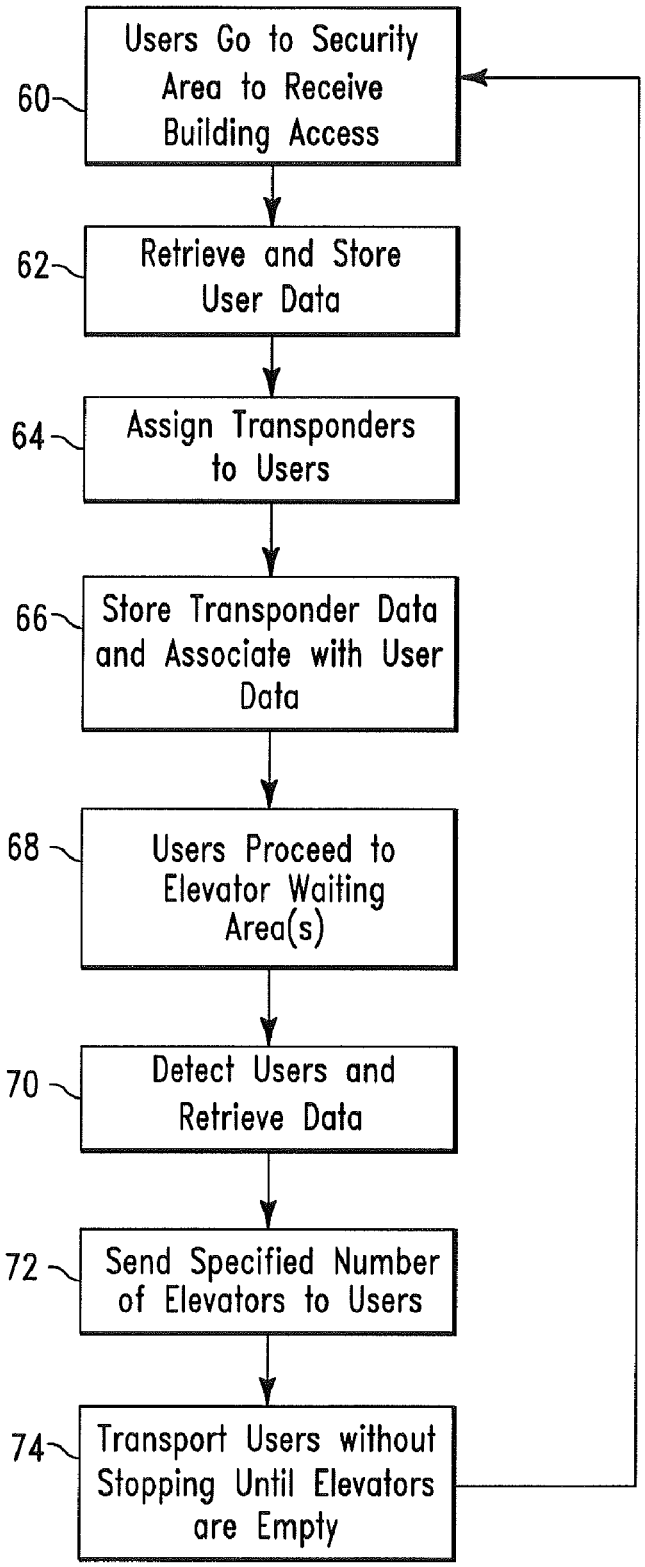
FIG. 4 is a flowchart illustrating an algorithm detailing an overall load limiting process used by system of FIG. 1, in accordance with embodiments of the present invention.

FIG. 4 is a flowchart illustrating an algorithm detailing an overall load limiting process used by system 2 of FIG. 1, in accordance with embodiments of the present invention. In step 60, users enter a building and go to a security area (e.g., a security desk) to receive access to different floors in the building. In step 62, user data is retrieved from the users and stored within database 5. In step 64, transponders (e.g., transponders 14A . . . 14D in FIG. 1) are assigned to the users. In step 66 transponder identification data is associated with the user data and stored in database 5. In step 68, the users proceed to an elevator waiting area. In step 70, the users are detected by a transceiver(s) (e.g., by one of transceivers 17A . . . 17D) and the user data is retrieved from database 5. In step 72, a specified number of elevators are dispatched to retrieve the users. The specified number of elevators is determined by control unit 11 and is based on a total number of users waiting for elevators. This process enables system 2 to dispatch enough elevators to account for weight capacities of the elevators. System 2 may additionally direct specified users to specified elevators. In step 74, each elevator transports retrieved users to their specified floors without stopping to retrieve any other users until each elevator is empty. When each elevator is empty, step 60 is repeated and the process begins again.

Figure 5:
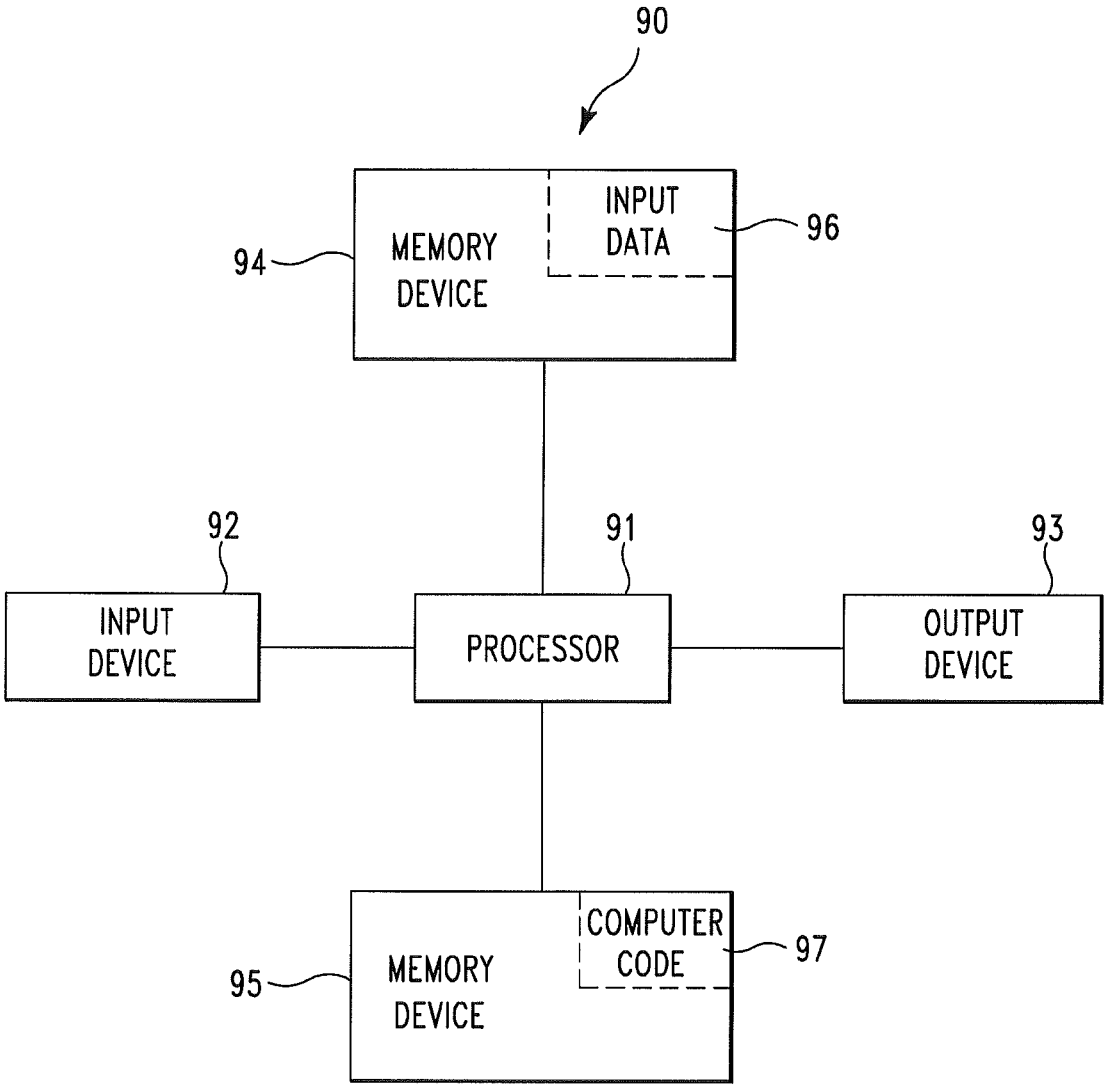
FIG. 5 illustrates a computer system used for implementing control unit of FIG. 1, in accordance with embodiments of the present invention.

FIG. 5 illustrates a computer system 90 used for implementing control unit 11 of FIG. 1, in accordance with embodiments of the present invention. The computer system 90 comprises a processor 91, an input device 92 coupled to the processor 91, an output device 93 coupled to the processor 91, and memory devices 94 and 95 each coupled to the processor 91. The input device 92 may be, inter alia, a keyboard, a mouse, etc. The output device 93 may be, inter alia, a printer, a plotter, a computer screen (e.g., monitor 110), a magnetic tape, a removable hard disk, a floppy disk, etc. The memory devices 94 and 95 may be, inter alia, a hard disk, a floppy disk, a magnetic tape, an optical storage such as a compact disc (CD) or a digital video disc (DVD), a dynamic random access memory (DRAM), a read-only memory (ROM), etc. The memory device 95 includes a computer code 97. The computer code 97 includes an algorithm for implementing the processes of FIGS. 2-4. The processor 91 executes the computer code 97. The memory device 94 includes input data 96. The input data 96 includes input required by the computer code 97. The output device 93 displays output from the computer code 97. Either or both memory devices 94 and 95 (or one or more additional memory devices not shown in FIG. 5) may comprise the algorithms of FIGS. 2 and 3 and may be used as a computer usable medium (or a computer readable medium or a program storage device) having a computer readable program code embodied therein and/or having other data stored therein, wherein the computer readable program code comprises the computer code 97. Generally, a computer program product (or, alternatively, an article of manufacture) of the computer system 90 may comprise said computer usable medium (or said program storage device).

While FIG. 5 shows the computer system 90 as a particular configuration of hardware and software, any configuration of hardware and software, as would be known to a person of ordinary skill in the art, may be utilized for the purposes stated supra in conjunction with the particular computer system 90 of FIG. 5. For example, the memory devices 94 and 95 may be portions of a single memory device rather than separate memory devices.

While embodiments of the present invention have been described herein for purposes of illustration, many modifications and changes will become apparent to those skilled in the art. Accordingly, the appended claims are intended to encompass all such modifications and changes as fall within the true spirit and scope of this invention.

What is claimed is:

1. A method, comprising:

receiving, by an elevator control unit within an elevator system, user data segments associated with users for elevators within said elevator system, each user data segment of said user data segments associated with a different user of said users, said elevator system comprising a memory unit, wherein said elevator system comprises a plurality of transceivers, and wherein each transceiver of said plurality of transceivers is electrically connected to said elevator control unit;

receiving, by said elevator control unit, transponder identification data segments associated with a plurality of transponders, each transponder identification data segment of said transponder identification data segments associated with a different transponder of said plurality of transponders, each transponder of said plurality of transponders associated with and possessed by a different user of said users;

storing said user data segments and said transponder identification data segments in said memory unit;

receiving, by said elevator control unit through a first transceiver of said plurality of transceivers, a first identification signal from a first transponder of said plurality of transponders, said first transponder possessed by a first user of said users, wherein said first transceiver is at a first location;

receiving, by said elevator control unit through said first transceiver, a second identification signal from a second transponder of said plurality of transponders, said second transponder possessed by a second user of said users;

retrieving, by said elevator control unit in response to said first identification signal, a first user data segment of said user data segments stored in said memory unit, said first user data segment associated with said first user;

retrieving, by said elevator control unit in response to said second identification signal, a second user data segment of said user data segments stored in said memory unit, said second user data segment associated said second user;

determining, by said elevator control unit, a first priority level for said first user based on said first user data segment, wherein said first priority level is associated with a first business related class associated with said first user;

determining, by said elevator control unit, a second priority level for said second user based on said second user data segment, wherein said second priority level is associated with a second business related class associated with said second user;

sending, by said elevator control unit, an elevator A of said elevators to said first location;

sending, by said elevator control unit to said first transponder, directions for locating elevator A of said elevators, wherein said directions are displayed by a display device of said first transponder;

transporting, by said elevator A, said first user to a second location in accordance with said first priority level;

sending, by said elevator control unit, an elevator B of said elevators to said first location; and transporting, by said elevator B, said second user to a third location in accordance with said second priority level, wherein said second priority level restricts said second user from accessing specified restricted locations.

2. The method of claim 1, further comprising:

receiving, by said elevator control unit through said first transceiver, a plurality of identification signals from a group of transponders of said plurality of transponders, said group of transponders possessed by a plurality of users of said users;

retrieving, by said elevator control unit through said first transceiver in response to said plurality of identification signals, a plurality of user data segments of said user data segments in said memory unit, said plurality of user data segments associated with said plurality of users; and sending, by said elevator control unit, a specified number of said elevators to said first location, said specified number based on the number of users comprising said plurality of users.

3. The method of claim 2, wherein said specified number of said elevators is two elevators, and wherein said method further comprises:

transporting, by a first elevator of said two elevators, said first user and a first group of said plurality of users to a second location in accordance with said first user data segment and said user data segments associated with said first group; and transporting, by a second elevator of said two elevators, said second user and a second group of said plurality of users to a third location in accordance with said second user data segment and said user data segments associated with said second group.

4. The method of claim 3, wherein said first user and a first group in combination comprises a first number of users, wherein a fourth location comprises a third group of said plurality of users, wherein said third group comprises a second number of users, wherein said first number of users in combination with said second number of users exceeds a maximum specified number of users for said first elevator, and wherein said method further comprises:

retrieving, by said elevator control unit, a group of user data segments of said user data segments, said group of user data segments associated with said third group of said plurality of users; and skipping, by said first elevator, said fourth location.

5. The method of claim 1, wherein said second transceiver is located at a second location, wherein said first location is different from said second location, and wherein said method further comprises:

comparing, by said elevator control unit, said first priority level to said second priority level to determine that said first priority level comprises a higher priority level than said second priority level; and first sending, by said elevator control unit, a first elevator of said elevators to said first location based on said comparing; and transporting, by said first elevator, said first user to said third location.

6. The method of claim 5, further comprising:

second sending after said first sending, by said elevator control unit, said first elevator to said second location; and transporting, by said first elevator, said second user to a fourth location.

7. The method of claim 5, further comprising:

second sending after said first sending, by said elevator control unit, a second elevator of said elevators to said second location; and transporting, by said second elevator, said second user to a fourth location.

8. The method of claim 1, wherein each of said plurality of transponders comprises an RFID tag.

9. The method of claim 8, wherein each of said transponder identification data segments comprises a serial number for a different RFID tag of said RFID tags.

10. An elevator control system comprising an elevator control unit, said elevator control unit comprising a processor coupled to a computer-readable memory unit, said memory unit comprising instructions that when executed by the processor implements the method of claim 1.

11. A computer program product, comprising a non-transitory computer storage medium comprising a computer readable program code stored therein, said computer readable program code comprising an algorithm performing the method of claim 1 upon being executed by a computer processor of said elevator control unit.

* * * * *